United States Patent [19]

Hydorn

[11] 4,127,155

[45] Nov. 28, 1978

[54] WATERPROOF BAG WITH WATERPROOF DIVIDER

[76] Inventor: Dennis H. Hydorn, 96 Walker Ave., Toronto, Ontario, Canada

[21] Appl. No.: 741,852

[22] Filed: Nov. 15, 1976

[51] Int. Cl.[2] ..... A45C 3/04

[52] U.S. Cl. ..... 150/1.7; 150/3; 150/12

[58] Field of Search ..... 150/1.7, 3, 12; 229/56

[56] References Cited

U.S. PATENT DOCUMENTS

| | | | |
|---|---|---|---|
| 1,251,404 | 12/1917 | Mills | 150/12 |
| 1,795,049 | 3/1931 | Shaffer | 229/56 |
| 1,953,895 | 4/1934 | Gihon | 150/1.7 |
| 2,452,994 | 11/1948 | Chodak | 150/1.7 |
| 2,457,422 | 12/1948 | Warner | 150/1.7 |
| 2,479,824 | 8/1949 | Fass | 150/1.7 |
| 2,674,289 | 4/1954 | Silverman | 150/3 |
| 3,204,678 | 9/1965 | Worcester | 150/1.7 |
| 3,402,749 | 9/1968 | Kinzler | 150/12 |
| 3,490,682 | 1/1970 | Schwarzkopf | 150/1.7 |
| 3,958,750 | 5/1976 | Prybeck | 229/56 |

*Primary Examiner*—Ro E. Hart

[57] ABSTRACT

A carrying bag is provided with an opening and includes two side panels. The side panels are laminated on their inner surfaces with a waterproof material and are separated by one or more waterproof, flexible dividers secured in the bag. Each divider essentially precludes the migration of water between the compartments in the bag.

3 Claims, 9 Drawing Figures

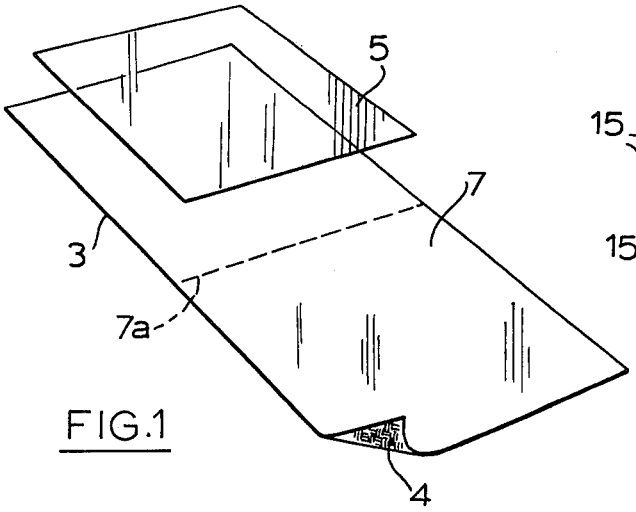
FIG.1
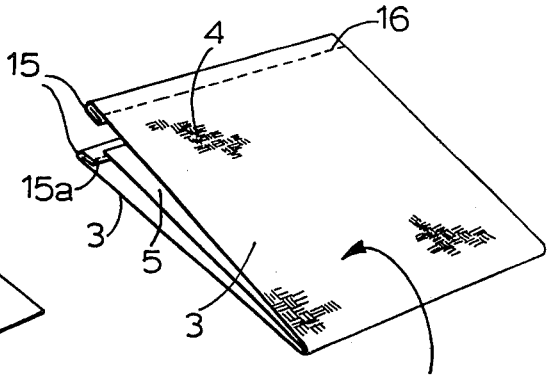
FIG.2
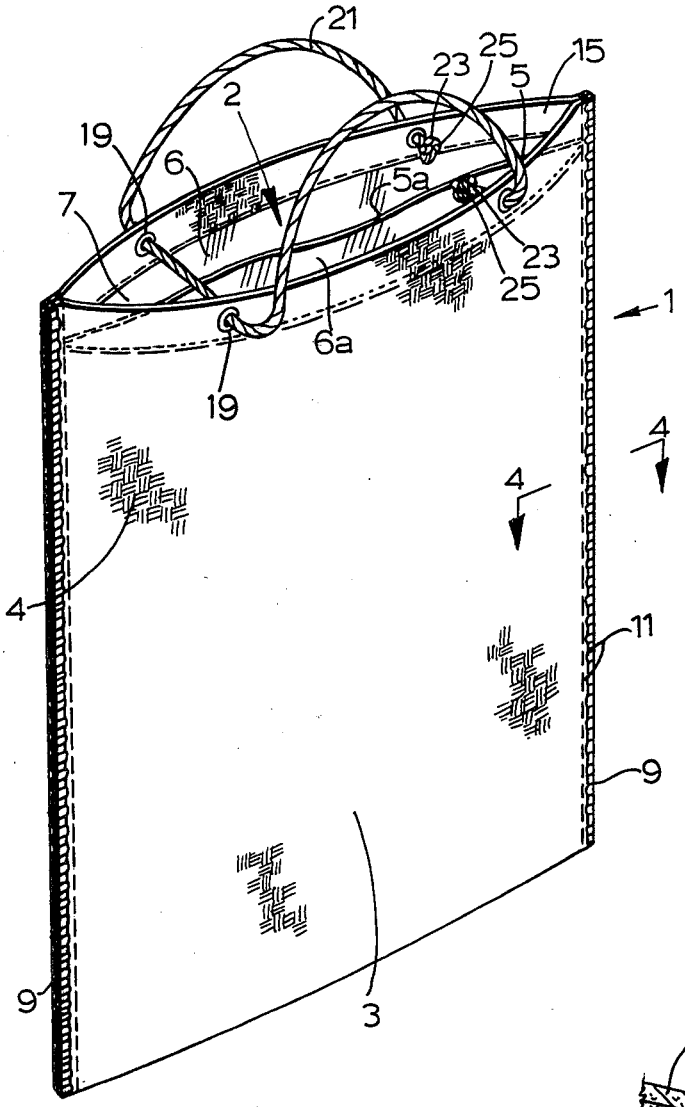
FIG.3
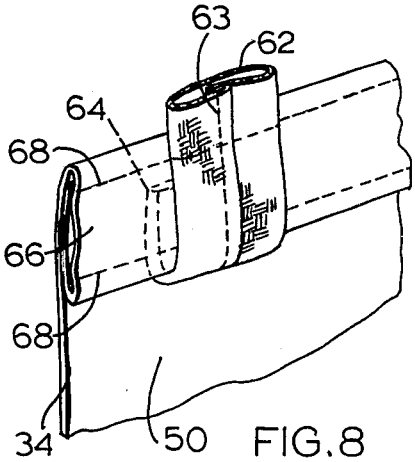
FIG.8
FIG.4
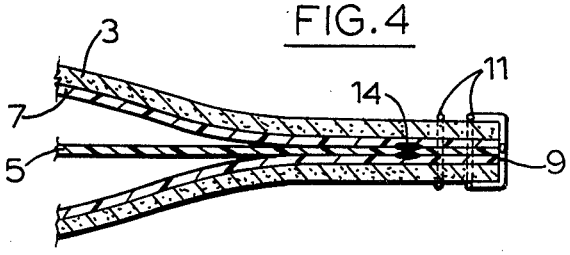

WATERPROOF BAG WITH WATERPROOF DIVIDER

FIELD OF THE INVENTION

This invention relates to a carrying bag having waterproof side panels and at least one internal waterproof divider which essentially precludes the migration of water between compartments in the bag.

BACKGROUND OF THE INVENTION

In the past it has been very difficult for a person to carry both wet and dry articles at one time. Usually two carrying bags have been required to keep the wet and dry articles separate from one another. The bag holding the wet articles usually had an undesirable leak or drip. If a person were carrying something in addition to the carrying bag, the wet and dry articles were wrapped in some type of waterproof material and placed in the same bag. This procedure required time to wrap the articles separately from one another and resulted in a waste of material because the waterproof wrapping was thrown away. Furthermore, it was almost invariably the case that the wrapping came loose when travelling and the articles came in contact with each other so that the articles which were dry when initially placed in the bag became wet or damp.

In addition to the above problems, it has been very hard to carry in a lightweight bag heavy objects such as large chilled pop bottles on which moisture forms in warm weather. The heavy bottles with moisture on their surfaces would weaken the bag's strength or discolour or damage the bag. Further, it is desirable to chill bottles of beverages in ice while maintaining other goods in the bag in a dry condition. It is also desirable to have a bag for carrying heavy bottles provided with carrying straps or handles.

It is therefore an object of this invention to provide a carrying bag having at least two separate compartments where water migration between compartments is precluded.

It is another object of the invention to provide a strong flexible carrying bag having at least two separate compartments capable of holding heavy objects.

It is a further object of the invention to provide a carrying bag having two separate compartments each being capable of holding water. The opening to the compartment may be provided with means for closing the opening.

It is yet another object of the invention to provide a durable, open ended carrying bag provided with a handle for carrying the bag, the bag being easily folded when empty to facilitate handling of the bag.

It is still a further object of the invention to provide an open ended carrying bag having handle means and two internal, flexible, waterproof dividers which have a closure device along their free edges to provide an internal watertight compartment which can be completely sealed by the closure device.

It is yet another object of the invention to provide a carrying bag having a handle which can be converted to a shoulder strap.

It is yet a further object of the invention to provide a strong carrying bag which will stand on its own so that it is easy to place articles in the bag.

BRIEF SUMMARY OF THE INVENTION

The carrying bag of this invention is provided with an opening and includes two side panels and at least one flexible waterproof divider between the two side panels. The side panels are constructed from a durable, flexible material and the internal surfaces of the panels are provided with a waterproof coating. The divider which has a similar shape to that of the side panels is secured in the bag at or near a major portion of the peripheries of the side panels to substantially separate the side panels and to provide at least two separate compartments whereby migration or seepage of water between compartments is precluded. The divider which may be heat sealed in the bag or by sonic welding, provides two compartments which are capable of carrying or holding water.

According to an aspect of the invention, the bag may be provided with means for closing the opening, such as a zipper, snaps, or the like. The bag may be provided with handle means for carrying the bag by hand or over the shoulder. The bag can also be carried under the arm without requiring the use of a handle.

According to another aspect of the invention, the bottom edges of the side panels are folded to provide a gussetted bottom so that the bag will stand on its own in an unsupported manner.

One or more pre-made bags of proper dimensions may be inserted between and secured to the bag side walls during assembly. The pre-made bag may be of plastic material and have a suitable closure device at its open end. Instead of the pre-made bags, two or more flexible waterproof dividers may be provided in the bag and secured to the periphery thereof. Upon heat sealing the dividers together and providing a suitable closure device at their open ends, one or more watertight and airtight compartments are formed within the bag.

DESCRIPTION OF THE DRAWINGS

The aforementioned and other objects, advantages and features of the invention will become apparent from the following detailed description of the preferred embodiments according to this invention as shown in the drawings wherein;

FIG. 1 is a view of an unassembled carrying bag according to this invention;

FIG. 2 is a view of a partially assembled carrying bag having two side panels with a flexible, waterproof divider located therebetween;

FIG. 3 is a side view of a fully assembled carrying bag according to an embodiment of this invention;

FIG. 4 is a cross-sectional view taken along the lines 4—4 of FIG. 3;

FIG. 8 appearing on the same page of drawings as FIGS. 1 through 4 is an enlarged view of the handle of the carrying bag of FIG. 5.

DETAILED DESCRIPTION OF THE PREFERRED EMBODIMENTS

Figure 5:
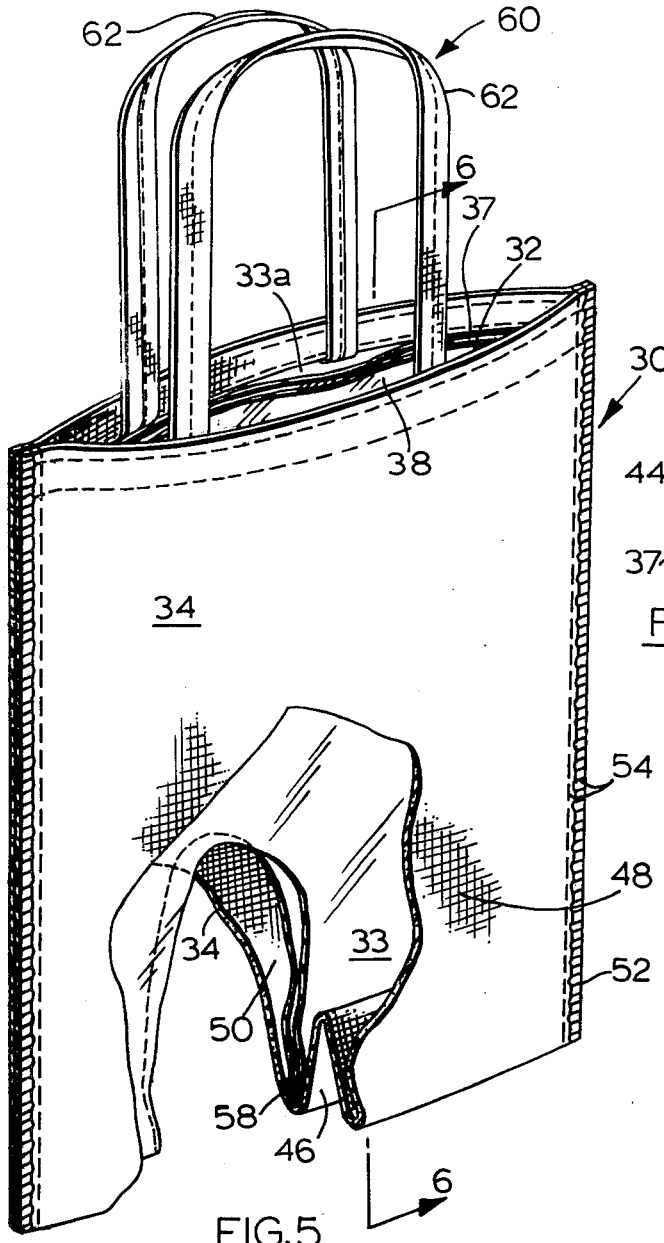
FIG. 5 shows an alternative embodiment of a carrying bag having two internal waterproof dividers according to this invention.
Figure 7:
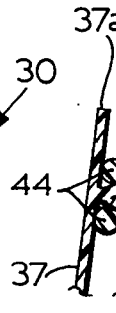
FIG. 7 shows a reusable sealing means used to seal the free edges of two internal waterproof dividers shown in FIG. 6.

Referring to FIGS. 1 through 4, a carrying bag generally indicated at 1 includes side panels 3 constructed of a strong, durable, textile fabric 4; such as jute or cotton which can easily be bleached white and dyed any colour. It has been found that a 10 ounce jute or cotton provides a desired combination of strength and flexibility so that the bag will easily hold heavy objects and yet can be rolled up to a very compact size when not being used. Other suitable materials such as leather or plastic can be used as well.

Prior to assembly the inner surfaces of the side panels are treated so as to lend them waterproof. The panels may be coated or sprayed with various types of waterproofing materials, for example, the "Scotchguard" treatment. A preferred form of waterproofing the panels to provide a durable product is to laminate the panels with an impermeable plastic material 7 preferably of a thickness of about 3 mils so that the side panels are both waterproof and flexible.

Also prior to assembly a company name or logo (not shown) can be printed on the bag by a silk screening process to produce a clear sharp reproduction of the name on the exterior textile surface of each side panel for advertising purposes. The silk screening process is preferably carried out after the inner surfaces have been laminated or provided with waterproof coating 7 and when the jute or cotton is in a flat form with the interior surface face down on the vacuum holding holes of a silk screening machine.

After side panels 3 have been laminated and silk screened, if desired, the upper ends 15 of the side panels are double folded over approximately 1 inch and sewn by a chain or lock stitch 16 running across the width of the folded portion of the bag leaving the natural jute or cotton exposed at the opening of the bag. If required, cardboard reinforcing may be located in the double fold before sewn. When the upper end of the side panels are folded and sewn, each side panel is approximately 16 inches long and 15 inches wide to provide a bag which when assembled is capable of holding large objects. However, as can be appreciated, the bag can have any desired shape and size.

A transparent, flexible waterproof divider 5 is positioned over the side panels as shown in FIG. 1. In the instance where the divider is plastic and the interior of the side panels is laminated with plastic, the divider is located on one of the panels 7 by heat spot welds. The bottom edge of the divider is located along fold line *7a*. After spot welding of the divider to the panel 7, the base of the divider 5 along its width is heat sealed to the panel 7 along fold line *7a*. The same process works for waterproofed cotton, although it may be somewhat slower.

The side panels 7 are then folded along fold line *7a* in the manner shown in FIG. 2. The side panels with the intermediate divider are secured by means of stitching 11 which extends down outer edges 9 of the bag in the manner shown in FIG. 3. A minor portion of the periphery is left unsecured to provide opening 2 thereby permitting access to the interior of the bag. Stitching 11 is preferably provided by means of a two needle safety surger having four or five threads. Alternatively, the stitching can be applied by a twin needle chain stitch using a single binder. After stitching, an electronic sealer or electronic sewing machine can be used to provide an additional seal in the form of a sonic internal weld as shown at 14 at the outer edges 9 as shown in FIG. 4. This sealing thereby provides two compartments which are capable of holding or carrying water.

After the bag is fully assembled as shown in FIG. 3, eyelets 19, which are provided with ¼ inch apertures are then pressed in by a pressing machine. The divider may be approximately 15 inches square to facilitate assembly so that there is no confusion as to the proper orientation of the divider in the bag and thereby saving in assembly costs. Free edge 5a terminates below opening 2 of bag 1 and preferably below double folded edge 15a so that the divider does not interfere with the insertion of objects in the bag. Also the divider is protected by the side panels and is not easily accessible to damage such as tearing and ripping.

The divider can be wider than the side panels and therefore project beyond the edges of the side panels across the width of the bag. The safety surger or twin needle includes cutting knives ahead of the needles for the removal of trimming of excess plastic or material thus ensuring that the divider is well fitted and secured in the bag.

When assembled, the bag includes two independent compartments 6 and 6a which are both accessible through opening 2 and because of divider 5 migration of water between the compartments 6 essentially precluded. Wet articles can be placed in one of the compartments while dry articles can be placed in the other of the compartments. Water cannot escape through the side panels due to the waterproofing of side panels 7 or cannot escape at the perimeter of the compartments other than through opening 2 because waterproof divider 5 is secured to laminations 7 by heat seal 14.

Bag 1 is provided with a handle in the form of rope 21. Since it may be desired to carry heavy articles in the bag, free edges 15 of side panels 3 are reinforced with stiff cardboard as earlier described. The rope is fitted through the eyelets as shown in FIG. 3 and provided at its ends 23 with knots 25 to prevent withdrawal of rope 21 from eyelets 19. If a person wants to carry the bag by hand, rope 21 can be doubled as shown in FIG. 3, or if a person would rather carry the bag over the shoulder, the rope can be extended by pulling one of the loops through the eyelets to provide a shoulder length.

Figure 6:
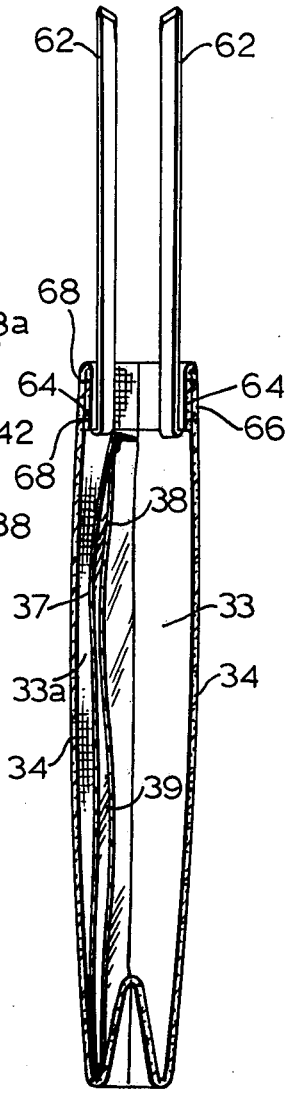
FIG. 6 is a sectional view taken along the lines 6—6 of FIG. 5.

It is often desirable to have a carrying bag that will stand on its own. Such a bag appears in FIGS. 5 through 8. In this embodiment side panels 34 of bag 30 are folded at their lower edges as shown in FIGS. 5 and 6 to provide gussetted bottom 46. The gusset extends upwardly approximately 2 inches and therefore when flattened by placing goods in the bag, roughly a 4 inch base is provided on which the bag is capable of standing when unsupported. Again it has been found that a 10 ounce jute or cotton 48 laminated with a 3 mil plastic 50 is a good combination. The side panels have the rigidity required to support the bag and the flexibility to conform to the shape of irregularly shaped objects placed in the bag.

The upper ends 66 of the side panels are double folded and reinforced so that only the natural jute or cotton is exposed in the manner shown in FIG. 8. However, before securing each of the reinforced upper ends 66 by means of chain stitching 68, the handle straps generally indicated at 60 are placed in position on the bag. The handle consists of two long thin strips of matching material cut from a long length of cotton or jute approximately 2¾ inches wide, folded and sewn at stitching 63 to a width of slightly of 1 inch by way of a custom perfected folder, chain stitch, pulling device and automatic cutter. The ends 64 of each strap are then tucked approximately ½ inch under the reinforced upper ends 66 of the side panels about 4 inches from the sides of the bag. The lower positioning dots for locating the handles may be silk screened on the upper ends 66 at the same time the exterior message is done thereby saving production—consumer costs. Further advertising material may be printed between the dots to appear inside the bag because of the folds. The lower of the two chain stitches is provided across the width of the bag at the bottom portion of the reinforced upper end with straps 62 extending into the interior of the bag so that the lower stitching only secures the end of the straps tucked under the double-folded upper end. Straps 62 are folded over reinforced upper ends 66 so they extend up from the bag. The upper of the two chain stitches 68 is then provided across the width of the side panels to hold the straps in the upward extending position.

Straps 62 are preferably of the same material and colour as side panels 34 to provide the bag with an appealing uniform appearance. It has been found that straps approximately 24 inches in length provide both a handle for carrying the bag by hand as well as a shoulder strap for carrying the bag over the shoulder. The handle consisting of two 24 inch straps is short enough that the bag will not drag on the ground when hand held and is long enough to enable a person carrying the bag to slip the arm through the handle and rest the straps on the shoulder.

Bag 30 also includes a pair of waterproof dividers 37 and 38. The dividers and panels are secured in a manner similar to that described for the carrying bag shown in FIGS. 1 through 4 to provide compartments 33 and **33*a* as well as additional compartment 39 between the dividers. Dividers 37 and 38 which are each about 4 mil polyethylene are secured to plastic lamination 50 provided on the inner surfaces of the side panels by means of spot welding to locate them for subsequent bottom heat sealing at 58 and sewing of side panels. Side panels 34 and dividers 37 and 38 are secured to one another by means of stitching 54 applied by a safety surger or twin needle single binder. The stitching extends down both sides of the periphery of the bag with opening 32 being provided at the upper end of the bag. As can be seen from FIG. 5, both dividers are sealed at the side of the gusset in the bottom of compartment 33*a*** so that the gussetted bottom can be flattened without tearing the dividers from the side of the bag. Again the waterproof dividers essentially preclude the migration of water between the compartments.

As previously mentioned, instead of two separate dividers being placed and secured between the side panels, a pre-made bag having a "Mini-Grip"* closure device may be located therein. The thickness of each bag side would be approximately 2 mil. The side edges of such a bag may have a wide flange seal extending down each side to provide an area through which the stitching may extend without affecting the seal around the bag edges.

* Trademark

Compartments 33 and **33*a* are open ended and access to the compartments is gained through opening 32. However, intermediate compartment 39 which is also accessible through opening 3, can be completely sealed by the male, female sealing device arrangement shown in FIG. 7. Dividers 37 and 38 or the complete bag sides are provided with free edges 37*a* and 38*a* located at or near the opening of the bag. Arranged below free edge 38*a* on the inner surface of divider 38 are two spaced projections 44 to provide a groove or female portion. Divider 37 is provided on its inner surface with a male portion in the form of single projection 42 located below free edge 37*a*. Projection 42 is press fitted between spaced projections 44 to seal compartment 39. Projections 44 and projection 42 are resilient and therefore the seal can be broken by pulling on free edges 37*a* and 38*a* to gain access to the interior of compartment 39. Due to the resiliency of the projections, the compartment can later be resealed. A preferred form of the sealing device is that sold under the trademark "Mini-Grip". A plastic zipper-like attachment can also be added to the male, female arrangement for closing. Unlike compartment 33 and 33*a*, compartment 39** is completely watertight and airtight and therefore is particularly useful for holding obnoxious odour causing objects such as fish or onions which a person would not want to mix with other objects in the bag.

Wet bathing suits, beverages and any other wet articles can be placed in one compartment and dry towels and clothes can be placed in another separate compartment. If by chance the beverages are spilled, they remain in the "wet" compartment without wetting the towels and clothes. The compartments in the bag are large and easy to get into and therefore they can easily be cleaned without damaging the bag.

Figure 9:
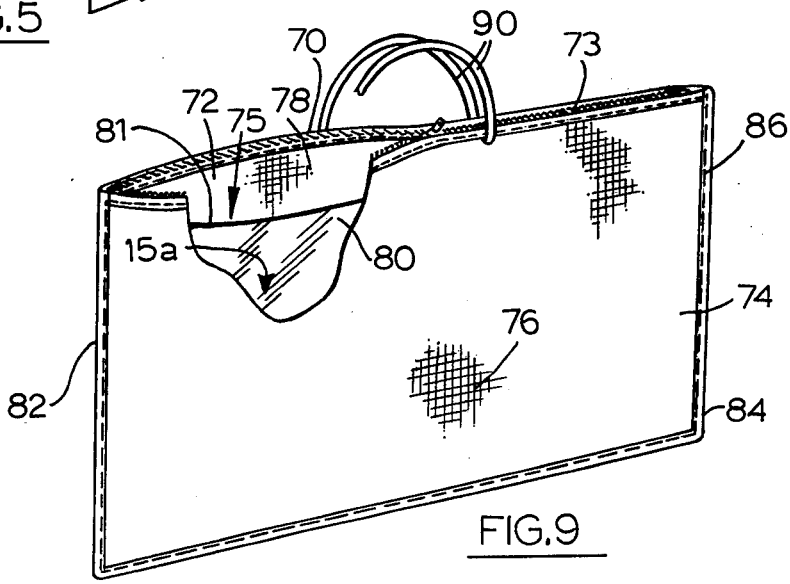
FIG. 9 is a top front plan view of a carrying bag having a zipper for closing an opening according to yet another embodiment of this invention.

The carrying bags shown in FIGS. 1 through 4 and 5 through 8 are often used as beach bags and other types of leisure tote bags. FIG. 9 shows an alternative embodiment of a bag according to this invention which can be used as an attache or work case to be carried under a person's arm or by way of a leather, textile or plastic strap handle 90. The bag, generally indicated at 70, includes two side panels 74 constructed from a durable flexible material such as jute or cotton.

Located between the side panels is a transparent waterproof divider 80. In this embodiment divider 80 is constructed of a material such as acetate or "Mylar" (trademark) to impart the degree of rigidity required in the bag. However, the divider is flexible enough that it will bend with the bag.

The inner surfaces of side panels 74 can be provided with waterproof laminations 78. Divider 80 is sealed to the laminations by means of a heat seal (not shown) and secured to the side panels by stitching 86 extending along a major portion of the periphery 82 of bag 70. Divider 80 can be additionally sealed to laminations 78 by means of sonic welding to provide two watertight compartments 75 and **75*a*. In order to give the bag a finished look, binding 84 is provided around the entire perimeter of the bag. Binding 84** can be constructed of a material such as a bias cotton which is double folded or a vinyl which is single folded.

Access to the watertight compartments is gained through opening 72 located at the unstitched portion of the periphery of the bag. Provided at opening 72 is a zipper 73 for zip closing the opening. Preferably the zipper is nylon so that it will not rust and is inexpensive.

Prior to assembly the divider is shorter and wider than side panels 74. The divider is secured in the bag by means of a safety surger having cutting knives in front of the needles or the double chain needle combination binder and therefore the divider has the same width as the side panels in the finished product. However, because the bag is provided with a zipper, free edge 81 of divider 80 terminates inside the bag slightly below the zipper 73 so that it does not interfere with the zipper closing of the bag.

It is understood that the method of constructing the carrying bags shown in FIGS. 1–9 is a matter of choice and therefore the method of construction is not an essential feature to this invention. Furthermore, the carrying bag according to this invention is not restricted to the aforementioned shapes, sizes and materials. Although various preferred embodiments of the invention have been described herein in detail, it will be apparent to those skilled in the art that variations may be made thereto without departing from the spirit of the invention or the scope of the appended claims.

The embodiments of the invention in which an exclusive property or privilege is claimed are defined as follows:

1. A carrying bag made of strong flexible material and having an open upper end, said bag being provided with a handle at said open upper end and two side panels separated from one another by two flexible waterproof dividers secured in said bag at the periphery thereof, said dividers each having a free edge terminating at said upper end, said side panels being laminated on their inner surfaces with a waterproof material, said dividers being sealed at the periphery of said bag to provide three compartments which are each capable of holding water, said dividers being releasably sealed to one another at their free edges by a closure device to provide a central compartment between said dividers, said closure device being of the type which seals off the central compartment in a manner so as to be watertight and airtight.

2. A carrying bag as claimed in claim 1 wherein one of said dividers is provided at its free edge with a male portion and the other divider is provided at its free edge with a female portion for engaging said male portion to detachably seal the open end of said central compartment.

3. A carrying bag as claimed in claim 1 wherein said bag includes a gussetted bottom for providing a base to support said bag when standing upright.

* * * * *